US011492898B2

(12) United States Patent
Sehsah et al.

(10) Patent No.: US 11,492,898 B2
(45) Date of Patent: Nov. 8, 2022

(54) DRILLING SYSTEM HAVING WIRELESS SENSORS

(71) Applicant: Saudi Arabian Oil Company, Dhahran (SA)

(72) Inventors: Ossama R. Sehsah, Al Khobar (SA); Peter Ido Egbe, Abqaiq (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 268 days.

(21) Appl. No.: 16/388,396

(22) Filed: Apr. 18, 2019

(65) Prior Publication Data

US 2020/0332652 A1 Oct. 22, 2020

(51) Int. Cl.
*E21B 47/13* (2012.01)
*E21B 47/007* (2012.01)
*E21B 10/42* (2006.01)

(52) U.S. Cl.
CPC ..... *E21B 47/13* (2020.05); *E21B 10/42* (2013.01); *E21B 47/007* (2020.05)

(58) Field of Classification Search
CPC ..... E21B 47/13; E21B 47/007; E21B 10/42
See application file for complete search history.

(56) References Cited

U.S. PATENT DOCUMENTS 4,655,300 A 4/1987 Davis, Jr. et al.
4,738,322 A 4/1988 Hall et al.
4,785,894 A 11/1988 Davis, Jr. et al.
6,216,533 B1 4/2001 Woloson et al.
7,789,171 B2 9/2010 Grayson et al.
8,376,065 B2 2/2013 Teodorescu et al.
9,464,487 B1 10/2016 Zurn
(Continued)

FOREIGN PATENT DOCUMENTS

GB 2 516 450 A 1/2015
GB 2525229 A 10/2015
(Continued)

OTHER PUBLICATIONS

International Search Report for PCT/IB2019/054477, 7 pages (dated Feb. 13, 2020).
(Continued)

*Primary Examiner* — Curtis B Odom
(74) *Attorney, Agent, or Firm* — Osha Bergman Watanabe & Burton LLP

(57) ABSTRACT

An example method for monitoring drilling includes releasing a wireless data retrieval device within a drill string in a wellbore, forcing fluid downhole through the drill string such that the data retrieval device travels in the fluid through a fluid outlet in a drill bit connected to the drill string, receiving data in the data retrieval device from a wireless sensor disposed on or in a body of the drill bit, and transferring the data from the data retrieval device after the data retrieval device travels in the fluid through the fluid outlet. An example wellbore drilling system includes a drill bit that includes a body, a fluid outlet, one or more wireless sensors disposed on or in the body, and a waterproof data retrieval device configured to receive data wirelessly from the wireless sensor(s), the data retrieval device having a size smaller than an opening in the fluid outlet.

19 Claims, 7 Drawing Sheets

(56) References Cited

U.S. PATENT DOCUMENTS

| | | | | |
|---|---|---|---|---|
| 9,869,176 | B2 | 1/2018 | Dickson et al. | |
| 2004/0069539 | A1 | 4/2004 | Sullivan et al. | |
| 2005/0104176 | A1 | 5/2005 | Rodney et al. | |
| 2005/0230149 | A1 | 10/2005 | Boucher et al. | |
| 2011/0290560 | A1 | 12/2011 | Buske et al. | |
| 2013/0118733 | A1 | 5/2013 | Kumar | |
| 2014/0231142 | A1 | 8/2014 | Poitzsch | |
| 2015/0308253 | A1* | 10/2015 | Clark | E21B 44/00 175/24 |
| 2017/0321485 | A1 | 11/2017 | Bhosle et al. | |
| 2018/0163530 | A1* | 6/2018 | Hay | E21B 47/024 |
| 2019/0040738 | A1* | 2/2019 | Ramjit | E21B 47/0232 |
| 2019/0169984 | A1* | 6/2019 | Smart | E21B 47/01 |
| 2019/0345818 | A1* | 11/2019 | DePavia | E21B 47/13 |
| 2019/0352973 | A1 | 11/2019 | Sehsah et al. | |

FOREIGN PATENT DOCUMENTS

| | | | |
|---|---|---|---|
| WO | WO-00/73625 | A1 | 12/2000 |
| WO | WO-2015/147786 | A1 | 10/2015 |
| WO | WO-2019/220197 | A1 | 11/2019 |

OTHER PUBLICATIONS

Written Opinion for PCT/IB2019/054477, 12 pages (dated Feb. 13, 2020).

* cited by examiner

DRILLING SYSTEM HAVING WIRELESS SENSORS

TECHNICAL FIELD

This specification describes examples of drilling systems and drilling system components having wireless sensors that enable monitoring during drilling.

BACKGROUND

Drill bits are used to penetrate a formation during wellbore drilling. Although generally made from hard materials, drill bits experience mechanical wear throughout their service lifetime. In many cases, multiple drill bits are needed to complete a wellbore due to the amount of wear to each of the drill bits. Moreover, drill bits frequently encounter formations having spatially variable properties, such as different hardness or density at different depths, which may differently impact drilling.

For certain applications, drilling is performed using casing while drilling (CWD). CWD systems may include systems for completing a wellbore by simultaneously drilling and casing the wellbore.

SUMMARY

Monitoring drilling conditions, including downhole conditions and drill bit conditions, may be desirable. This specification describes examples of components, such as drill bits and torque rings, that include wireless sensors for monitoring drill bit conditions, such as bit wear, bit balling, weight-on-bit, or drill bit drag, and downhole conditions, such as drill string vibration, stick-slip, torque, or drill string drag.

An example method for monitoring drilling in a wellbore includes releasing a wireless data retrieval device within a drill string disposed in the wellbore. The method includes forcing fluid downhole through the drill string such that the wireless data retrieval device travels in the fluid through a fluid outlet in a drill bit connected to the drill string. The method includes receiving data in the wireless data retrieval device from a wireless sensor disposed on or in a body of the drill bit. The method includes transferring the data from the wireless data retrieval device after the wireless data retrieval device travels in the fluid through the fluid outlet. The wireless sensor may be an RFID-enabled sensor. The method may include one or more of the following features, either alone or in a combination.

The method may include retrieving the wireless data retrieval device from the fluid when the fluid exits the wellbore. The data may be transferred after the wireless data retrieval device has been retrieved. Transferring the data from the wireless data retrieval device may occur as the fluid exits the wellbore. The data may be transferred from the wireless data retrieval device to a non-transitory machine-readable storage medium using an RFID reader. The data may be transferred using a near-field communication protocol.

The method may include releasing a plurality of wireless data retrieval devices into the drill string. The method may include forcing fluid downhole through the drill string such that each of the plurality of wireless data retrieval devices travel in the fluid through a fluid outlet in the drill bit. The method may include receiving data in each of the wireless data retrieval devices from one or more wireless sensors disposed on or in the body of the drill bit. The method may include transferring the data from the plurality of wireless data retrieval devices. The method may include retrieving the plurality of wireless data retrieval devices from the fluid when the fluid exits the wellbore, where transferring the data from the plurality of wireless data retrieval devices occurs after all of the plurality of wireless data retrieval devices have been retrieved.

The data may correspond to one or more downhole conditions, one or more drill bit conditions, or both one or more downhole conditions and one or more drill bit conditions. The data may correspond to at least one of temperature, pressure, acceleration, torque, or rotational velocity.

The method may include determining bit wear based, at least in part, on the data. The method may include determining whether stick-slip is occurring based, at least in part, on the data. The method may include determining drill string drag based, at least in part, on the data. The method may include determining weight-on-bit based, at least in part, on the data. The method may include determining drill string vibration based, at least in part, on the data. The method may include determining a state of bit balling based, at least in part, on the data.

The method may include receiving data in the wireless data retrieval device from a plurality of wireless sensors disposed on or in the body of the drill bit. The method may include determining an average downhole condition, an average drill bit condition, or both an average downhole condition and an average drill bit condition, based, at least in part, on data received from each of the plurality of wireless sensors.

The method may include receiving data in the wireless data retrieval device from one or more wireless sensors disposed in or on one or more torque rings, where the one or more torque rings are each disposed between ends of two casing pipes in the drill string. The method may include determining an average downhole condition based, at least in part, on data received from one or more wireless sensors disposed in or on each of a plurality of torque rings, where each of the plurality of torque rings are disposed between ends of two casing pipes in the drill string. The method may include determining an average downhole condition based, at least in part, on the data received from the sensor and data received by the one or more wireless sensors. The method may include determining an average downhole condition based, at least in part, on data received from at least one of the one or more wireless sensors disposed in or on at least one of the one or more torque rings and the wireless sensor disposed on or in the body of the drill bit.

The method may include determining an average downhole condition, an average drill bit condition, or both, based, at least in part, on data transferred from a plurality of wireless data retrieval devices.

An example method for monitoring drilling in a wellbore includes releasing a wireless data retrieval device within a drill string disposed in the wellbore. The method includes forcing fluid downhole through the drill string such that the data retrieval device travels in the fluid to a drill bit connected to the drill string. The method includes receiving data in the wireless data retrieval device from a wireless drill bit sensor disposed on or in a body of the drill bit. The method includes transferring the data from the wireless data retrieval device. The method may include transferring the data along a line data transmission line physically connected to the data retrieval device. The method may include retracting a data retrieval device tether physically connected to the data retrieval device, where transferring the data occurs after retracting.

An example wellbore drilling system is configured to monitor drilling in a wellbore. The wellbore drilling system may include a drill bit that includes a body that is connectable to a drill string. The drill bit may include a fluid outlet. The drill bit may include one or more wireless sensors disposed on or in the body. The body may include one or more blades. Each of the one or more blades may include a plurality of cutting elements. The wellbore drilling system may include a data retrieval device configured to receive data wirelessly from the one or more wireless sensors. The data retrieval device may be waterproof. The data retrieval device may have a size smaller than an opening in the fluid outlet. The wellbore drilling system may include one or more of the following features, either alone or in a combination.

The one or more wireless sensors may include an RFID-enabled sensor. The data retrieval device may be RFID-enabled.

The wellbore drilling system may include a torque ring. The torque ring may include a hollow-cylindrical body configured to be disposed between two pipes in a drill string. The pipes may be casing pipes. The torque ring may include one or more torque ring wireless sensors. The one or more torque ring wireless sensors may be disposed on or in the hollow-cylindrical body. The wireless data retrieval device may be configured to receive data wirelessly from the one or more torque ring wireless sensors. The one or more torque ring wireless sensors may include an RFID-enabled sensor.

The wellbore drilling system may include a retractable data transmission line physically configured to connect to the data retrieval device. The wellbore drilling system may include a retractable data retrieval device tether configured to connect to the data retrieval device physically. The wireless data retrieval device may be a stand-alone encapsulated device.

An example torque ring is configured to be disposed between pipes in a drill string. The torque ring may include a hollow-cylindrical body configured to be disposed between ends of two casing pipes in a drill string. The torque ring may include one or more wireless sensors. The one or more wireless sensors may be disposed on or in the hollow-cylindrical body. The torque ring may include one or more of the following features, either alone or in a combination.

The one or more wireless sensors may each be embedded in the hollow-cylindrical body below a surface of the hollow-cylindrical body. The one or more wireless sensors may each be enclosed in a corresponding cavity in a surface of the hollow-cylindrical body.

The one or more wireless sensors may include an RFID-enabled sensor. The one or more sensors may each be configured to determine one or more downhole conditions.

The one or more wireless sensors may include a sensor configured to measure at least one of temperature, pressure, acceleration, torque, or rotational velocity. The sensor may be configured to measure rotational velocity, torque, or both rotational velocity and torque. The sensor may be configured to measure acceleration.

Any two or more of the features described in this specification, including in this summary section, may be combined to form implementations not specifically explicitly described in this specification.

At least part of the methods, systems, and techniques described in this specification may be controlled by executing, on one or more processing devices, instructions that are stored on one or more non-transitory machine-readable storage media. Examples of non-transitory machine-readable storage media include read-only memory, an optical disk drive, memory disk drive, and random access memory. At least part of the methods, systems, and techniques described in this specification may be controlled using a computing system comprised of one or more processing devices and memory storing instructions that are executable by the one or more processing devices to perform various control operations.

The details of one or more implementations are set forth in the accompanying drawings and the following description. Other features and advantages will be apparent from the description and drawings, and from the claims.

DESCRIPTION OF THE DRAWINGS

Like reference numerals in the figures generally indicate like elements.

DETAILED DESCRIPTION

Figure 1:
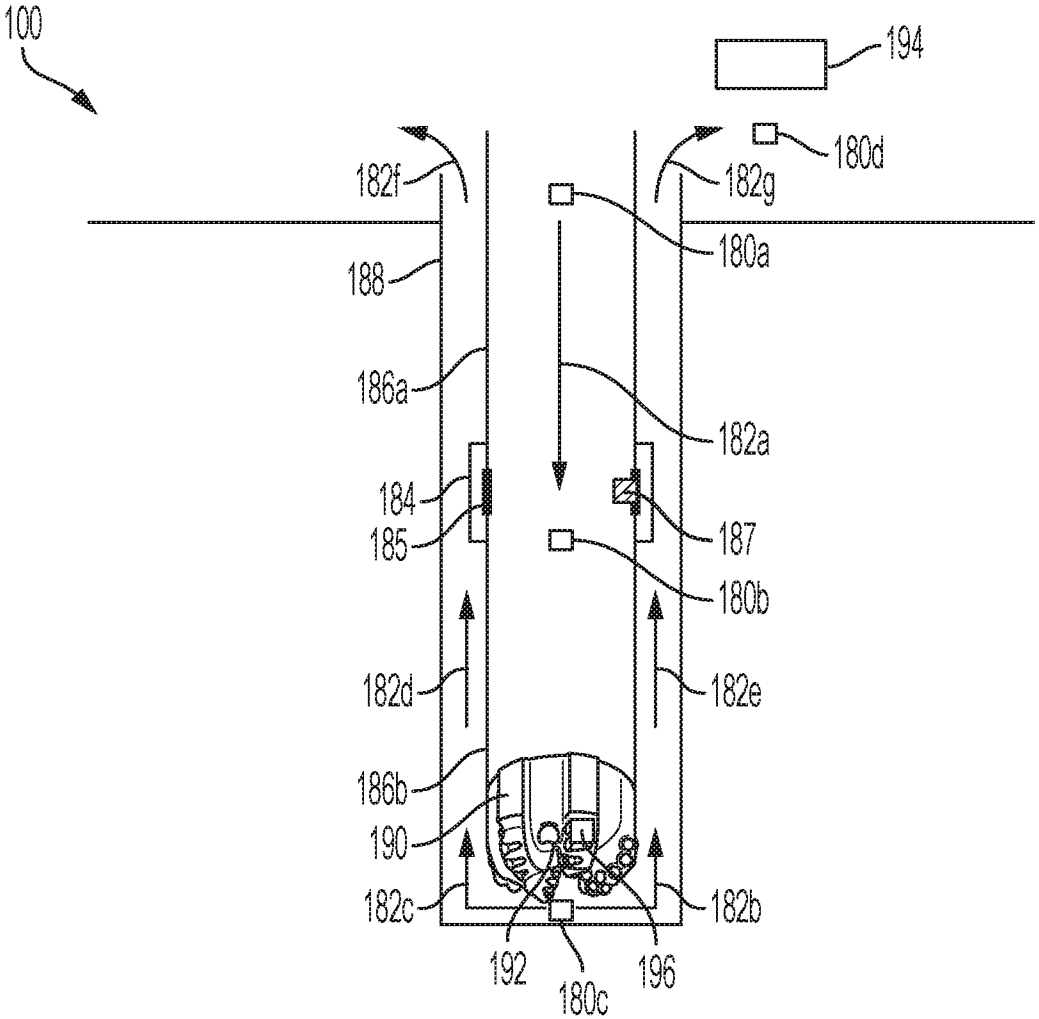
FIG. 1 is a schematic representation that illustrates an example method of data collection from a torque ring and drill bit.

Described in this specification are example implementations of drill bits and torque rings that include one or more sensors. In some implementations, the drill bit and torque rings are used in a casing while drilling (CWD) system. CWD systems may include systems for simultaneously drilling and installing casing in a wellbore, which may reduce time, and therefore costs, to complete casing of a wellbore. The sensors may include wireless sensors, such as radio frequency identification (RFID) sensors. Also described in this specification are example methods of collecting data from the sensors in the drill bits and torque rings, for example in order to determine one or more downhole conditions, one or more drill bit conditions, or both. This specification also describes examples of wellbore drilling systems and components, such as drill bits and torque rings, and methods that include real-time feedback for use in monitoring or determining one or more downhole conditions, one or more drill bit conditions, or both. The systems may include one or more sensors that may be disposed on or in the drill bit or one or more torque rings, for example, to perform the monitoring. In the context of a drill bit system, real-time feedback may not mean that example actions, such as communication, are simultaneous, immediate, or comport with any temporal requirements, but rather that the example actions may occur on a continuous basis or track each other in time, taking into account delays associated with processing, electronic or physical data transmission, or hardware, for example.

Examples of drill bit conditions include, but are not limited to, drill bit wear, weight-on-bit, and a state of bit balling. Examples of downhole conditions include, but are not limited to, stick-slip, drill string vibration, and drag. The example systems also enable monitoring, including real-time monitoring, of one or more drilling conditions downhole. One or more drilling conditions may include one or more drill bit conditions, one or more downhole conditions, or a combination of both one or more drill bit conditions and one or more downhole conditions. The example systems and components described in this specification may improve drilling, for example by allowing an operator to update drilling parameters or to determine when to change a drill bit based on monitoring of the drilling conditions. Updating drilling parameters may reduce or prevent damage to a bottom hole assembly (BHA) during drilling.

A drill bit is used to drill a wellbore. The drill bit may include one or more blades and each of the one or more blades may include cutting elements. The cutting elements may include teeth or any other appropriate structure, such as inserts, to cut through rock and other material to form or to extend a wellbore. The cutting elements may be formed from, or include, diamond. Examples include cutting elements made from polycrystalline diamond compact (PDC). An example drill bit also includes a drill bit body connected mechanically to a drill string. The drill bit body may include a matrix material, such as tungsten carbide, for example. The matrix material provides mechanical durability to the drill bit, for example thereby improving useable drilling lifetime. The matrix material may include a metallic binder that binds the matrix material together. The drill bit body may include steel. The drill bit may be configured to connect to a retrievable bottom hole assembly (BHA) or a non-retrievable BHA. The drill bit may be configured to drill through one or more of, for example, bedrock, shale, clay, and sand.

The drill bit may include one or more fluid outlets to allow fluid to flow from within the drill string to a drilling interface between the wellbore and the drill bit. The fluid outlets may be sized and shaped to allow a wireless data retrieval device to travel through them when carried by the fluid, as explained subsequently. In some implementations, one or more fluid outlets include a nozzle. In some implementations, a hole formed through a drill bit body defines a fluid outlet. In some implementations, the drill bit includes one central fluid outlet that may have a large diameter relative to an outer diameter of the drill bit, for example a diameter that is at least 60%, at least 70%, or at least 80% as large as the outer diameter of the drill bit. In some implementations, the drill bit includes a plurality of fluid outlets disposed around the drill bit. As an example, the drill bit may include at least one outlet between each pair of adjacent blades.

The drill bit may include one or more sensors, for example one or more wireless sensors. The one or more wireless sensors may include a wireless local area network enabled (WLAN (wireless local area network)-enabled) sensor, a radio-frequency identification enabled (RFID-enabled) sensor, or a Bluetooth-enabled sensor. In some implementations, each wireless sensor is an RFID-enabled sensor. For example, an RFID-enabled sensor may be a sensor that uses a near-field communication (NFC) protocol to communicate, for example with an RFID-enabled wireless data retrieval device. RFID-enabled sensors can be advantageous because they are relatively low-cost and use relatively small amounts of power to transmit data.

Different sensors may be disposed on or in different portions of the drill bit body. For example, one sensor may be disposed on or in a shoulder of the drill bit body while another sensor is disposed on or in a blade face of the drill bit body. In an example, yet another sensor may be disposed on or in a junk slot of the drill bit body. Multiple sensors may be disposed on or in the drill bit body in a similar area, such as a blade face of the drill bit body for example, to provide an average measurement for the area. Each of a plurality of similar sensors may be disposed on or in the drill bit body at a unique one of a set of corresponding areas, such as each blade face or junk slot of the drill bit body. The configuration of sensor(s) on or in the drill bit body of the drill bit may be based on the type or configuration of drill bit used.

In some examples, a drill bit sensor may be configured to measure one or more local properties at the drill bit. These local properties may be usable to determine drill bit conditions or downhole conditions. Local properties that may be measured by a drill bit sensor include, for example, temperature, pressure, acceleration, torque, or rotational velocity. Sensors suitable for use in measuring such properties include, but are not limited to, accelerometers, pressure sensors, temperature sensors (for example, thermocouples), wear sensors, torque sensors, fluid sensors, debris sensors, erosion sensors and combination sensors including any two or more of the preceding sensors. A sensor included in a drill bit may be configured to determine one or more downhole conditions, one or more drill bit conditions, or a combination of one or more downhole conditions and one or more drill bit conditions. The determination of one or more downhole or drill bit conditions may occur locally in each drill bit sensor, for example using a processor, such as a passive or active circuit, that is included in the sensor. The sensor may then transmit, to the surface, data representing the determined one or more downhole or drill bit conditions. Alternatively, each drill bit sensor may transmit data based on or representing one or more local properties that is used to determine the one or more downhole or drill bit conditions remotely from the sensor. For example, the determination may be performed using a computing system at the surface of the wellbore or a computing system that the data is sent to from the surface of the wellbore.

Each drill bit sensor may measure only one local property or multiple local properties. Each drill bit sensor may measure the same one or more local properties as each other drill bit sensor or may measure a unique one or set of local properties. When a plurality of drill bit sensors measure a same local property, an average downhole condition may be determined based on data for the same local property transmitted from each of the plurality of drill bit sensors.

A torque ring holds different sections of casing or pipe together. Each torque ring includes a torque ring body, for example made from a metal such as stainless steel. In some implementations, a torque ring body has a hollow cylindrical shape. The torque ring may include one or more torque-ring sensors disposed on or in the torque-ring body. The one or more sensors disposed on or in the torque-ring body may be one or more wireless sensors, such as one or more RFID-enabled sensors, one or more WLAN-enabled sensors, one or more Bluetooth-enabled sensors, or a combination of these sensors. RFID-enabled sensors are generally inexpensive and consume low amounts of power. Therefore, in some implementations, the one or more torque-ring sensors are each an RFID-enabled sensor. Wireless torque-ring sensors also simplify the process of receiving data from the sensors in order to monitor drilling conditions by eliminating the need to physically connect sensors in each torque ring to a data transmission line. Wireless sensors used in a torque ring may be, for example, the same as those described previously for use in a drill bit. Data transmitted from the one or more torque-ring sensors may be retrieved in a manner similar to that described previously in this specification, for example with respect to retrieving data from drill bit sensors and with respect to methods of data retrieval.

One or more torque-ring sensors, such as wireless sensors, may be disposed on or in the torque-ring body of a torque ring. The one or more sensors may be embedded in the torque-ring body. For example, the one or more sensors may be embedded in a matrix material used in the torque-ring body. The one or more sensors may be disposed on, for example attached to, the torque-ring body. The one or more sensors may be disposed, for example enclosed, in a cavity in a surface of the torque-ring body. Any combination of one or more of attaching, embedding, and enclosing in a cavity may be used to dispose the one or more sensors on or in the torque-ring body.

The one or more torque-ring sensors may include a sensor configured to determine one or more downhole conditions. In some examples, a torque-ring sensor configured to determine a downhole condition is one that measures one or more local properties at the torque ring that can be used to determine the downhole condition, for example after measurement data is received by a data retrieval device. The determination of the one or more downhole conditions may occur locally in each torque-ring sensor, for example using a processor, such as a passive or active circuit, that is included in the sensor, such that the sensor transmits data for the determined one or more downhole conditions. Alternatively, each torque-ring sensor may transmit data of the one or more local properties that is used to determine the one or more downhole conditions remotely from the sensor. For example, the determination may be performed using a computing system at the surface of the wellbore or a computing system that the data is sent to from the surface of the wellbore.

Local properties that may be measured by a torque-ring sensor include, for example, temperature, pressure, acceleration, torque, or rotational velocity. Each torque-ring sensor may measure only one local property or multiple local properties. Each torque-ring sensor may measure the same one or more local properties as each other torque-ring sensor or may measure a unique one or set of local properties. When a plurality of torque-ring sensors measure a same local property, an average downhole condition may be determined based on data of the same local property transmitted from each of the plurality of torque-ring sensors. The plurality of torque-ring sensors may be disposed around a periphery of the torque ring, for example, in an evenly spaced arrangement. Similarly, data from torque-ring sensors disposed on or in different torque rings in a drill string may be used to determine an average downhole condition.

A downhole condition determined by or using measurement data from a torque-ring sensor may be, for example, stick-slip, torque on the drill string, drill string vibration, or drag. Drag may be determined using a sensor that measures rotational velocity and by calculating a rate of change of the rotational velocity. That stick-slip occurring may also be determined by comparing a torque measured by one or more torque-ring sensors against a baseline torque. Drill string vibration can be determined using a torque-ring sensor that measures acceleration. Additionally, drag when pulling (the drill bit) out of hole or running (the drill bit) in hole can be determined using a sensor that measures acceleration. Generally, acceleration may be measured in a horizontal or vertical direction or both horizontal and vertical directions, for example relative to a direction of drilling. By using torque-ring sensors disposed on or in torque rings from different locations in a drill string that may be distributed over a substantial distance, for example over 1 kilometer (km) (0.62 miles (mi)), a more complete and spatially resolved understanding of the drilling conditions for the drill string can be had.

In some implementations, a downhole condition is determined repeatedly over time. For example, a downhole condition may be determined periodically. For example, the downhole condition may be determined about every minute over a 30 minute period, or longer. Periodic determination may occur, in part, due to periodic release of data retrieval devices into a drill string, as discussed further subsequently. In some implementations, each determination of a downhole condition is compared against a time-averaged downhole condition or range of previous downhole conditions. In some implementations, if a downhole condition is determined to have changed by more than a fixed amount, for example at least 5 percent or at least 10 percent, then the change in downhole condition is recorded, communicated, or both recorded and communicated. For example, an electronic log may be kept or an electronic alert may be displayed to an operator.

Figure 2:
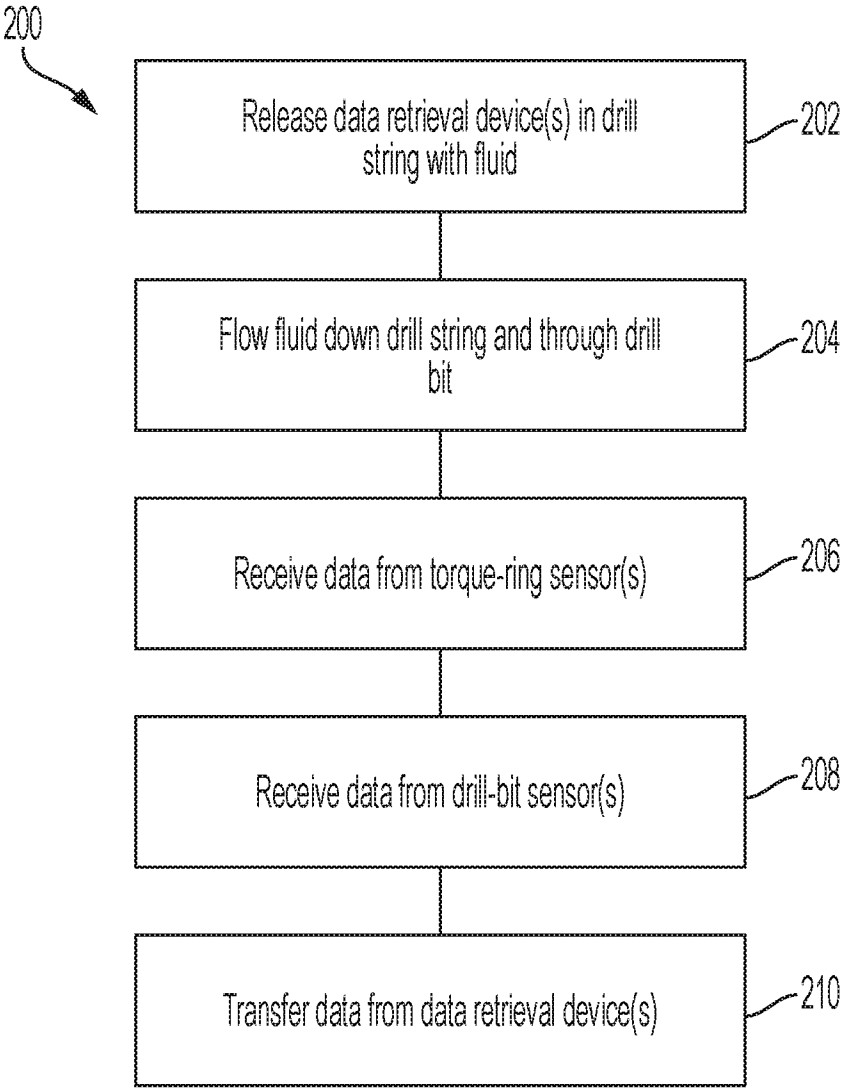
FIG. 2 is a block flow diagram of an example method for collecting data from a torque ring and drill bit.

Referring now to FIG. 1 and FIG. 2, an example method 200 includes monitoring one or more drilling conditions during drilling of a wellbore 100 using casing while drilling. In operation 202, one or more wireless data retrieval devices 180*a-d* are released into a drill string. The wireless data retrieval devices are released with, and carried by, fluid that is pumped into the wellbore such as drilling fluid or mud.

In this regard, a data retrieval device used to receive data from one or more sensors may be a stand-alone encapsulated device. In some such implementations, a data retrieval device may be released into the drill string to receive data, for example while fluid is flowing into and through the drill string, for example as described with respect to FIGS. 1 and 2. In some examples, a data retrieval device may be configured to connect to a tether that is used to retrieve the device in order to transmit its data to a computing system for processing, analysis, or both processing and analysis. In some examples, a data retrieval device may be configured to connect to a data transmission line to allow for transmission of data from the data retrieval device without needing to remove the data retrieval device from the drill string. A tether (or data transmission line) allows a data retrieval device to be repositioned to different torque rings or the drill bit without needing to recycle the data retrieval device or release another data retrieval device, for example as described with respect to FIG. 3. Release of one or more data retrieval devices, retraction of a tether or data transmission line, or both may be automatically controlled, for example timed, by the computing system.

In the example of FIG. 1, the drill string includes casing pipes 186*a-b*, collar 184, torque ring 185, and drill bit 190. Collar 184 and torque ring 185 hold pipes 186*a-b* together. One or more wireless torque-ring sensors 187 are disposed on or in torque ring 185. One or more wireless drill bit sensors 196 are disposed on or in a drill bit body of drill bit 190. In some implementations, one or more of the wireless torque ring sensors, the wireless drill bit sensors, or both are RFID (radio-frequency identification)-enabled. Examples of drill bits, data retrieval devices, torque rings, and sensors that that may be used to perform the methods disclosed in this specification, including example method 200, are described in detail subsequently.

In operation 204, fluid is introduced into the drill string and flows through the drill string toward drill bit 190 as indicated by arrow 182*a*. The fluid carries the data retrieval devices 180*a-d* with it. The fluid flows through one or more fluid outlets 192, which may include one or more nozzles on the drill bit. Once through the drill bit 190, the fluid is directed upwards back towards the surface, as indicated by arrows 182*b-c*. The fluid continues upward along the wellbore perimeter 188, as indicated by arrows 182*d-e*. Eventually, the fluid returns to the surface as indicated by arrows 182*f-g*.

In operation 206, as each wireless data retrieval device 180*a-d* passes by torque ring 185 as a result of the flowing fluid, the wireless data retrieval device may receive data from the one or more torque-ring sensors. In operation 208, as each wireless data retrieval device 180*a-d* passes through drill bit 190 as a result of the flowing fluid, the wireless data retrieval device may receive data from the one or more wireless drill bit sensors. The data received from the one or more torque ring sensors, the one or more drill bit sensors, or both may represent one or more downhole conditions, one or more drill bit conditions, or a combination of one or more downhole conditions and one or more drill bit conditions, as described subsequently. The data received from the one or more torque ring sensors, the one or more drill bit sensors, or both may be used to determine one or more downhole conditions, one or more drill bit conditions, or a combination of one or more downhole conditions and one or more drill bit conditions, as described subsequently. Due to local conditions, each wireless data retrieval device 180*a-d* may receive data from none, some, or all of the wireless torque-ring sensors disposed on or in torque ring 185 or none, some, or all of the wireless drill bit sensors disposed on or in the drill bit body of drill bit 190.

In FIG. 1, wireless data retrieval devices 180*a-d* are shown at different stages of travel through drill string 190 and wellbore 100. For example, wireless data retrieval device 180*a* has been released into the drill string, but the fluid has not yet passed the device into proximity with torque ring 185. Wireless data retrieval device 180*b* has been released into the drill string. The fluid has carried wireless data retrieval device 180*b* past torque ring 185, where the device may have received data from one or more wireless torque-ring sensors. Wireless data retrieval device 180*c* has been carried by the fluid through fluid outlet 192 and is in proximity with drill bit 190 where it may have received data from one or more wireless drill bit sensors. Wireless data retrieval device 180*d* has been carried back to the surface by the fluid and exited the wellbore. Wireless data retrieval device 180*d* may have received data from one or more wireless torque-ring sensors, one or more wireless drill bit sensors, or both.

In operation 210, data received from one or more torque-ring sensors, from one or more drill bit sensors, or from both torque-ring sensors and drill bit sensors is transferred from each wireless data retrieval device that had been released into the drill string. Transferred data may be processed, analyzed, or processed and analyzed to determine current downhole conditions, current drill bit conditions, or both current downhole conditions and current drill bit conditions.

In FIG. 1, wireless data retrieval device 180*d* is in proximity with data transfer device 194. Data transfer device 194 may be an RFID reader, for example connected to a remote computing system used for data processing, analysis, or both data processing and analysis. Alternatively or additionally, wireless data retrieval device 180*d* may be extracted from the fluid and subsequently brought into physical proximity with data transfer device 194 to transfer data from device 180*d* to device 194. Data transfer device 194 may be disposed near where the fluid naturally exits the wellbore. In some examples, data is transferred from wireless data retrieval devices, such as wireless data retrieval device 180*d*, to data transfer device 194 as they exit the wellbore in the fluid. Data transfer occurs due, in part, to proximity of the wireless data retrieval devices to data transfer device 194 when the fluid exits the wellbore.

Data may be transmitted from a data retrieval device as the data retrieval device exits the wellbore. Data may be transmitted from the data retrieval device after the data retrieval device is retrieved from the fluid that carries the data retrieval device/The data may be transmitted wirelessly using a spatially proximate wireless transfer device, such as an RFID reader, a WLAN (wireless local area network)-enabled reader, or a Bluetooth-enabled reader. A physically retrieved data retrieval device may transfer data stored in the device using a wireless data transfer protocol, such as an RFID (for example, NFC—near field communication) protocol, WLAN protocol, or Bluetooth protocol, or using a wired transfer protocol, such as universal serial bus (USB) or Ethernet protocol, if the device includes a corresponding data transfer port.

Multiple data retrieval devices may be used to receive data from the sensor(s) periodically, intermittently, or sporadically, for example by releasing each of the devices at different times during drilling. For example, a data retrieval device may be released more frequently than every 30 seconds, about every 30 seconds, about every minute, about every 5 minutes, about every 10 minutes, or less frequently than every 10 minutes. Additionally or alternatively, multiple data retrieval devices may be released at the same time. Releasing a plurality of stand-alone data retrieval devices simultaneously may improve data retrieval, for example in the event that one or more of the data retrieval devices is damaged while flowing through the drill string, the wellbore, or near or through the drill bit while the drill bit rotates.

As another example, releasing a plurality of stand-alone data retrieval devices may improve data retrieval in the event that one or more of the data retrieval devices does not successfully receive data from one or more torque-ring sensors, one or more drill bit sensors, or both. Data retrieval may not be successful if, for example, wireless signal transmission between the data retrieval device and the sensor(s) is blocked due to the composition of fluid between the sensor(s) and the device or the distance between the sensor(s) and the device as the device flows by the sensor(s).

As another example, releasing a plurality of stand-alone data retrieval devices may improve data retrieval in the event that the data retrieval devices flow through multiple fluid outlets on a drill bit. For example, if the drill bit has multiple fluid outlets but each outlet does not have a sensor disposed nearby, a single stand-alone data retrieval device may pass through an outlet that is too far away from any sensor to receive any data. In such a situation, using a plurality of stand-alone data retrieval devices would increase the likelihood that data are collected from the sensors.

Data received by a plurality of data retrieval devices may be averaged or otherwise processed by the computing system. Averaging data received by multiple data retrieval devices may reduce the likelihood of non-representative values received from one data retrieval device presenting an inaccurate understanding of realistic conditions to an operator. For example, a single data retrieval device may pass by a torque ring or the drill bit at a particular time that results in the device receiving anomalous data that would otherwise skew interpretation of one or more drilling conditions.

Figure 3:
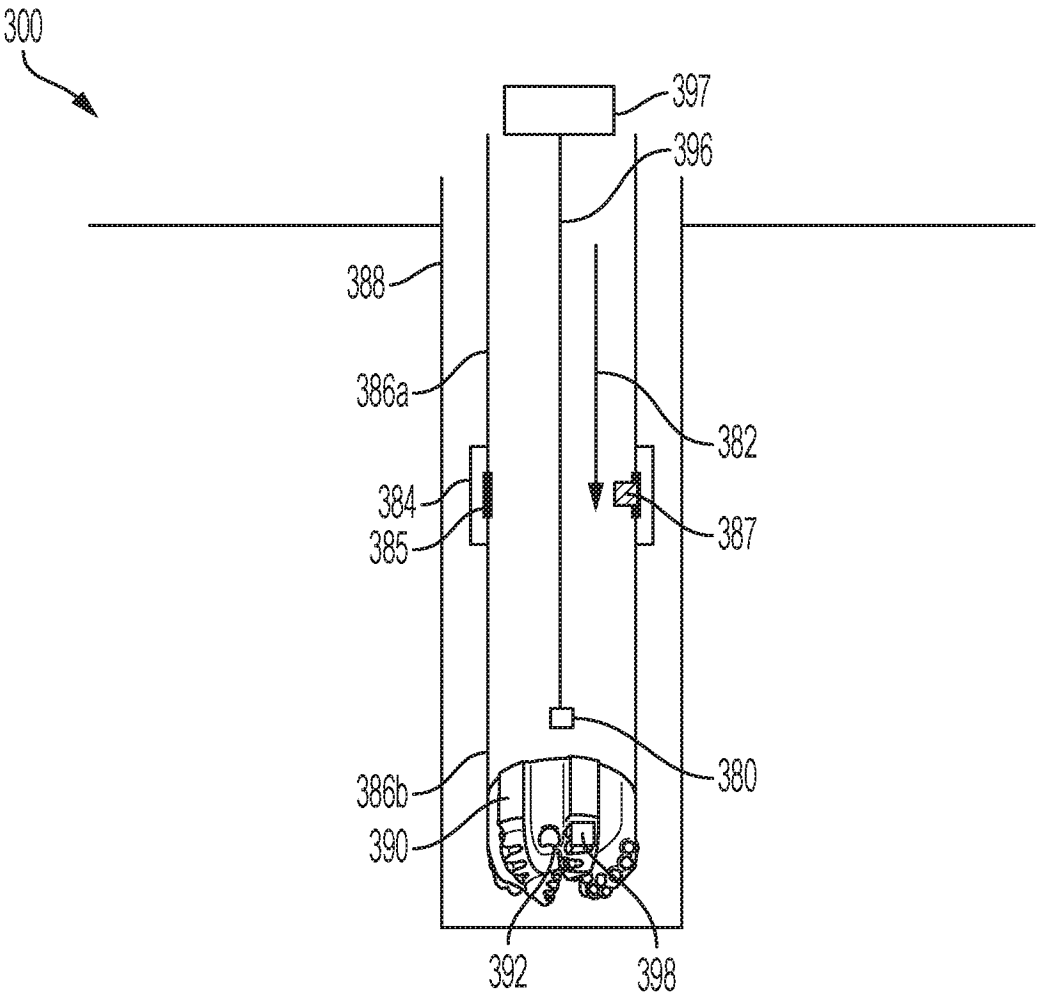
FIG. 3 is a schematic representation that illustrates an example method of data collection from a torque ring and drill bit.

FIG. 3 shows another example system for monitoring drilling in a wellbore 300. In this example, the drill string includes casing pipes 386*a-b*, collar 384, torque ring 385, and drill bit 390. Collar 384 and torque ring 385 hold pipes 386*a-b* together. One or more wireless torque-ring sensors 387 are disposed on or in torque ring 385. One or more wireless drill bit sensors 398 are disposed on or in a drill bit body of drill bit 390. In some implementations, the one or more wireless torque ring sensors, the one or more wireless drill bit sensors, or both are RFID-enabled. In operation, fluid flowing (represented by arrow 382) carries wireless data retrieval device 380 past torque ring 385 and to drill bit 390. The fluid flows through fluid outlet 392 and back to the surface at the perimeter of wellbore 388. Wireless data retrieval device 380 is attached to tether 396 and therefore does not flow through fluid outlet 392 with the fluid. The use of a tether to physically retrieve data retrieval device 380 contrasts with the example shown in FIG. 1 where the fluid is used to return the data retrieval devices to the surface in order to transmit their data, for example for use in monitoring one or more drilling conditions.

Referring still to FIG. 3, wireless data retrieval device 380 may receive data from the one or more wireless drill bit sensors, the one or more torque-ring sensors, or both the one or more wireless drill bit sensors and the one or more torque-ring sensors either as the fluid carries the data retrieval device downward to drill bit 390 or upon retraction of tether 396, or both when the fluid carries the data retrieval device downward and during retraction of tether 396. To transmit data received in wireless data retrieval device 380, tether 396 is retracted to the surface to provide access to the data retrieval device. Retraction of tether 396 is performed by retraction device 397, which may be, for example, a hoist. Retraction device 397 is configured to allow data retrieval device 380 to freely travel downward with fluid prior to retraction. In some implementations, wireless data retrieval device 380 is similarly attached to a data transmission line, in place of a tether, that can be used to transmit data to the surface in real time without the need to retract the data transmission line up hole in order to retrieve the data.

Figure 4B:
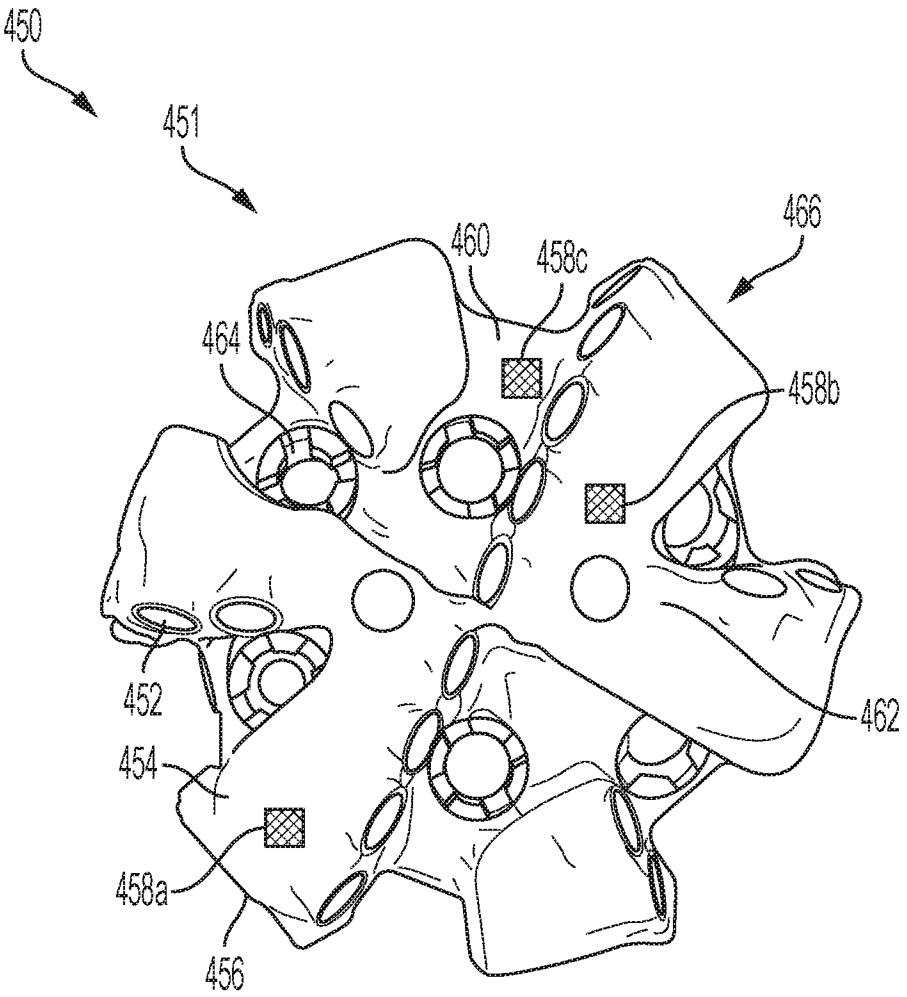
FIG. 4B is a view of an example drill bit with a plurality of drill bit sensors disposed on or in the drill bit.
Figure 4A:
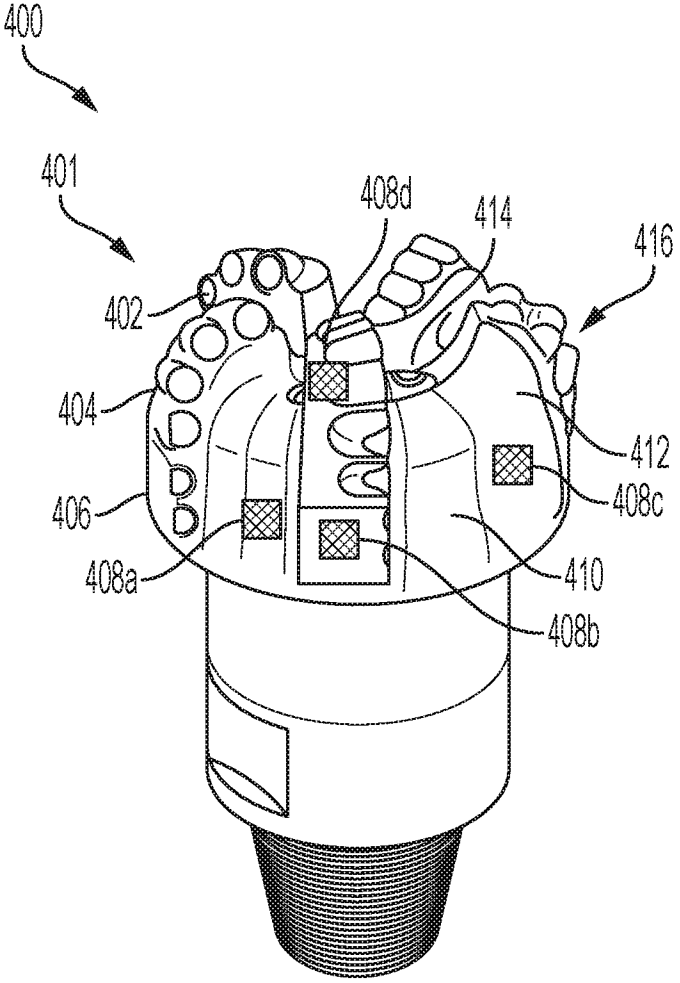
FIG. 4A is a view of an example drill bit with a plurality of drill bit sensors disposed on or in the drill bit.

FIG. 4A shows a view of an example drill bit 400 having one or more sensors configured to monitor one or more drilling conditions. Example drill bit 400 includes a drill bit body 401 that includes blades 416 that each include a plurality of cutting elements 402. In this example, drill bit body 401 includes five blades. Each blade 416 includes a shoulder 404, a gauge 406, and a blade face 412. The size and shape of the shoulder 404, gauge 406, and blade face 412 of each blade 416 determine, at least in part, useable drilling parameters for example drill bit 400, such as rate of penetration (ROP), and may be tailored for a formation with certain characteristics (for example composition or density). The gauge determines a diameter of the wellbore drilled by the example drill bit 400. Drill bit body 401 also includes junk slots 410 (sometimes referred to as waterways). Example drill bit 400 includes wireless sensors 408*a-d* disposed on or in drill bit body 401. Wireless sensor 408*a* is disposed on or in a junk slot 410. Wireless sensor 408*b* is disposed on or in a gauge 406. Wireless sensor 408*c* is disposed on or in a blade face 412. Wireless sensor 408*d* is disposed on or in a shoulder 404 of a blade 416. Example drill bit 400 also includes fluid outlets 414 that allow fluid to flow from in the drill string through the drill bit 400, for example to cool drill bit 400 or assist in carrying away debris from the drilling interface between the drill bit 400 and the wellbore formation during drilling. In some examples, debris and fluid flows through junk slots 410 during drilling. Fluid outlet 414 are nozzles. Example drill bit 400 can be used in a casing while drilling application.

FIG. 4B shows a top-down view of an example drill bit 450 having one or more sensors configured to monitor one or more drilling conditions. FIG. 4B has a different arrangement of blades, junk slots, and nozzles than the arrangement of example drill bit 400 in FIG. 4A. The arrangement of example drill bit 450 may be preferable over the arrangement of example drill bit 400 for drilling of formations with certain characteristics (for example, composition or density). Example drill bit 450 includes drill bit body 451 that includes six blades 466. Each blade 466 includes a gauge 456, a shoulder 454, a nose 462, a blade face (unlabeled) and a plurality of cutting elements 452. The size and shape of the shoulder 454, gauge 456, nose 462, and blade face of each blade 466 determine, at least in part, useable drilling parameters for example drill bit 450, such as rate of penetration (ROP), and may be tailored for a formation with certain characteristics (for example composition or density). Gauge 156 determines, at least in part, a diameter of the wellbore drilled by the example drill bit 400. Dill-bit body 451 includes junk slots 460 between blades 466. Example drill bit 450 includes wireless sensors 458*a-c* disposed on or in drill bit body 451. Wireless sensor 458*a* is disposed on or in a shoulder 454. Wireless sensor 458*b* is disposed on or in a nose 462. Wireless sensor 458*c* is disposed in a junk slot 460. Example drill bit 450 also includes fluid outlets 464 that allow fluid to flow from in the drill string through the drill bit 450. Fluid outlets 464 are nozzles. Wireless sensor 458*c* is disposed near a fluid outlet 464. Example drill bit 450 can be used in a casing while drilling application.

Figure 5B:
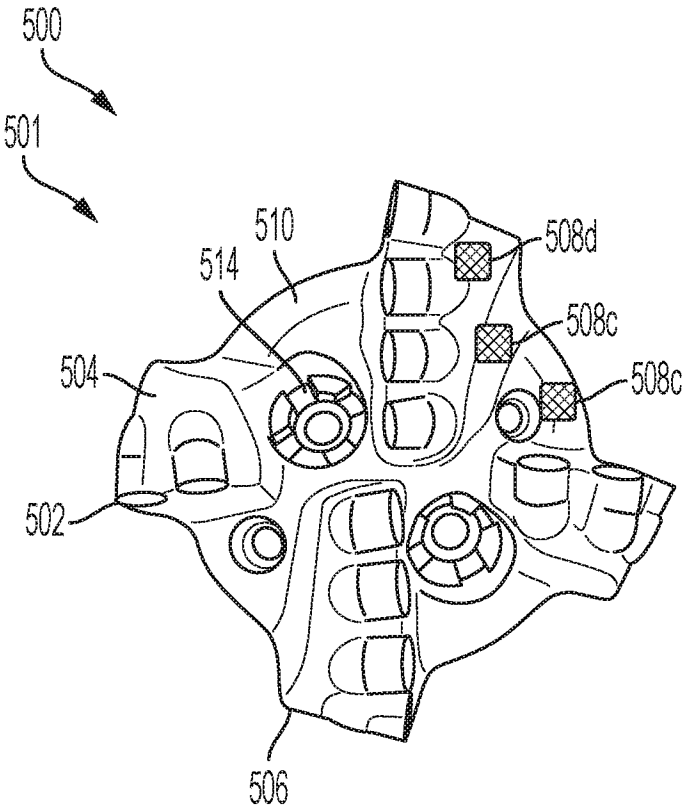
FIG. 5B is a top-down view of FIG. 5A.
Figure 5A:
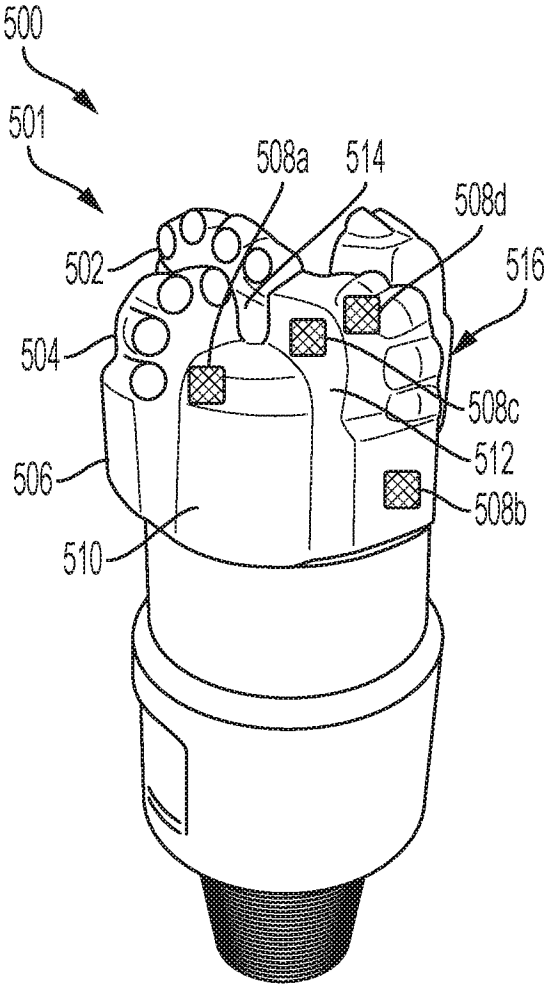
FIG. 5A is a view of an example drill bit for drilling shale or sand with a plurality of drill bit sensors disposed on or in the drill bit.

FIG. 5A shows an example drill bit 500 having sensors configured to monitor one or more drilling conditions. Example drill bit 500 is constructed for drilling in softer shale or sand by having taller blades and wider junk slots. Example drill bit 500 includes a drill bit body 501 that includes blades 516 that each include a plurality of cutting elements 502. In this example, drill bit body 501 includes four blades. Each blade 516 includes a shoulder 504, a gauge 506, a blade face 512. Drill bit body 501 also includes junk slots 510. Example drill bit 500 includes wireless sensors 508*a-d* disposed at various locations on or in drill bit body 501. Wireless sensor 508*a* is disposed on or in a junk slot 510. Wireless sensor 208*b* is disposed on or in a gauge 506. Wireless sensor 508*c* is disposed on or in a blade face 212. Wireless sensor 508*d* is disposed on or in a shoulder 504 of a blade 516. Example drill bit 500 also includes fluid outlets 514 that allow fluid to flow from in the drill string through the drill bit 500. Some of fluid outlets 514 are nozzles. FIG. 5B shows a top-down view of the drill bit shown FIG. 5A.

One or more of sensors may be disposed in or on a body of the drill bit, as shown in FIGS. 4A, 4B, 5A, and 5B. A sensor may be attached to the drill bit body, for example on a surface of the drill bit body. A sensor may be disposed below a surface of the drill bit body. For example, the sensor may be embedded in the drill bit body below the surface. In some implementations, the sensor is embedded in the matrix material contained in the drill bit body. A sensor may be disposed in a corresponding cavity in the drill bit body. Each of the sensors may be disposed on or in one of a nose, a shoulder, a blade face, a gauge, or a junk slot of the drill bit body. A sensor may be disposed on or in each of the nose, the shoulder, the blade face, the gauge, or the junk slot of the drill bit body. A sensor may be disposed in or on a cutting element of the drill bit.

A downhole condition determined by a drill bit sensor or determined using measurement data from a drill bit sensor may be, for example, stick-slip, torque on the drill string, drill string vibration, or drag. Drag may be determined using a sensor that measures rotational velocity and by calculating a rate of change of the rotational velocity. That stick-slip is occurring may be determined by comparing a torque measured by one or more drill bit sensors against a baseline torque. Drill string vibration can be determined using a drill bit sensor that measures acceleration. Additionally, drag when pulling (the drill bit) out of hole or running (the drill bit) in hole can be determined using a sensor that measures acceleration. Generally, acceleration may be measured in a horizontal or vertical direction, or both horizontal and vertical directions, for example relative to a direction of drilling.

A drill bit condition determined by or using data from a drill bit sensor may be, for example, a cutting structure condition, life expectancy of the drill bit, drill bit wear, weight-on-bit, or a state of bit balling. Bit wear may be determined by an increase in the magnitude of potential contact between a sensor and drilling formation. Cutting structure condition can similarly be determined. For example, a drill bit sensor mounted behind a cutting structure may be used to determine if and when the cutting structure has been completed worn through (for example, causing the drill bit sensor to become exposed). Life expectancy of the drill bit can be determined based on the rate of bit wear, for example. Weight-on-bit can be determined using an accelerometer or force sensor during drilling, for example to determine the effective weight on the bit based on the force applied to the bit. Such a determination alleviates the need to estimate weight on bit using imprecise surface measurements that compare weight when the bit is off bottom to when the bit is on (touching) bottom. A state of bit balling can be determined, for example, using the amount of a sensor surface that is covered by formation during drilling, or a length of time that it is covered. A state of bit balling can be determined using multiple sensors disposed in close physical proximity, for example in the same junk slot or on the same blade.

In some implementations, a drill bit includes a power supply or energy storage mechanism, such as a battery or a generator, to power electrical components of the drill bit. In some implementations, each sensor, the electrical system connected to each sensor, or both, is powered by a source attached to, or integrated into, the drill bit. In some implementations, a sensor includes its own power supply or energy storage mechanism. In some implementations, a plurality of sensors are connected to a common power supply or energy storage mechanism. In some implementations, a sensor is powered wirelessly, for example using an antenna configured to convert a signal from a wireless data retrieval device.

A sensor may transmit data without storing the data. In some implementations, a wireless sensor transmits data continuously as the data is generated by the sensor. In some implementations, a wireless sensor transmits data only when prompted by a wireless data retrieval device used to retrieve sensor data to bring the data to the wellbore surface, for example using an RFID protocol, such as an NFC protocol. In some implementations, a wireless sensor does not store data locally. For example, the wireless sensor does not include a memory. Accordingly, a data retrieval device receives a set of data corresponding only to when the data retrieval device is in wireless communication with—for example, within physical proximity of—the wireless sensor. In this way, the wireless data retrieval device may receive instantaneous or real-time downhole condition(s), drill bit condition(s), or both from the wireless sensor, but does not receive data corresponding to times when the data retrieval device is not in wireless communication with the wireless sensor. In some implementations, data can be transmitted from a wireless sensor, for example to a wireless data retrieval device, over a distance of at least 0.05 meters (m) (0.16 feet (ft)), at least 0.1 m (0.33 ft), at least 0.25 m (0.82 ft), at least 0.5 m (1.6 ft), at least 1 m (3.3 ft), at least 2 m (6.6 ft), or at least 5 m (16 ft).

A sensor may temporarily store data locally. For example, a sensor may include a memory to store data corresponding to one or more downhole conditions, one or more drill bit conditions, or both, from a period of time. For example, an RFID-enabled sensor may have a memory for storing data over a period of time. In this way, when a wireless data retrieval device comes into wireless communication with the wireless sensor, such as the RFID-enabled sensor, it may receive data corresponding to a period of time that is more than just the time during which the wireless data retrieval device is in wireless communication with the wireless sensor. A wireless sensor may be configured to store data representing measurements made by the sensor in a memory with a certain discontinuous frequency such that the sensor captures measurements made over a longer period of time than if the measurements continuously recorded. By varying the frequency with which wireless data retrieval devices are provided, the size of the memory in the sensor, and the frequency with which sensor measurements are stored locally, a more or less continuous stream of data can be retrieved and brought to the surface. In some implementations, a wireless sensor is configured to overwrite data once received by a wireless data retrieval device, for example when confirmed using an NFC protocol.

A sensor may be, or include, a wear sensor. In some implementations, a wear sensor may be, or include, an erosion sensor. In some implementations, an erosion sensor may include a metal probe element having a certain thickness. As the metal probe element is subjected to wear, the thickness of the metal probe element decreases. This produces a corresponding change in electrical properties, such as resistance, of the metal probe element. A change in an electrical property may be detected, for example, by monitoring a voltage or current applied to the metal probe element. This change in the electrical property is indicative of the amount of wear detected by the sensor.

A wear sensor may be, or include, a fluid sensor. In some implementations, a fluid sensor may be, or include, a water sensor. An example fluid sensor is configured to measure a difference in conductivity between two electrodes. A predefined difference in conductivity may be indicative of the presence of fluid or the lack of at least a predefined amount of fluid in a region measured. A fluid sensor can be placed in or on a drill bit such that the electrodes are exposed to wellbore fluid only after a certain amount of material has worn off the drill bit, thereby indicating a certain level of wear. In some implementations, a fluid sensor may be or include a temperature probe. Other types of fluid sensors may be used, as appropriate.

A sensor may be, or include, a lubrication sensor which may be configured to collect data that is usable for to monitor the condition of lubrication of the drill bit. A lubrication sensor may be, or include, an ultrasonic sensor, such as a sensor for registering a change in acoustic properties in reflected sound waves. A lubrication sensor may be, or include, a conductive sensor that uses conductive properties of the oil or other material to perform point-level detection.

In some implementations, one or more wireless sensors disposed, for example embedded, in a drill bit may be used to assess wear in a drill bit. For example, wear can be assessed based on a reduction in the outside diameter of the drill bit. In some implementations, one, two, three, or more sensors may be positioned inside the body of the drill bit at different distances from an outside surface of the drill bit body. As the drill bit is worn down, each sensor may become exposed, degraded or destroyed, or otherwise have its local environment changed such that the sensor starts sending data, data sent from the sensor changes, or data ceases being sent from the sensor. The new or changed data are received, or some of the data is no longer received, by a data retrieval device when in proximity with the sensor, for example when flowing in fluid through the drill bit. In some implementations, an operator may determine a level of wear of the drill bit based on data, or the timing of data, from one or more wireless drill bit sensors. In some implementations, one or more wireless drill bit sensors used to measure wear may be one or more fluid sensors, one or more debris sensors, one or more wear sensors, one or more erosion sensors or a combination of one or more of one or more fluid sensors, one or more debris sensors, one or more wear sensors, and one or more erosion sensors. One or more of the sensors may be placed in, or on, a drill bit as appropriate, such as on or near areas of a drill bit that are particularly prone to wear. For example, wear sensors or fluid sensors may be attached to or embedded in a drill bit described in this specification.

Figure 6:
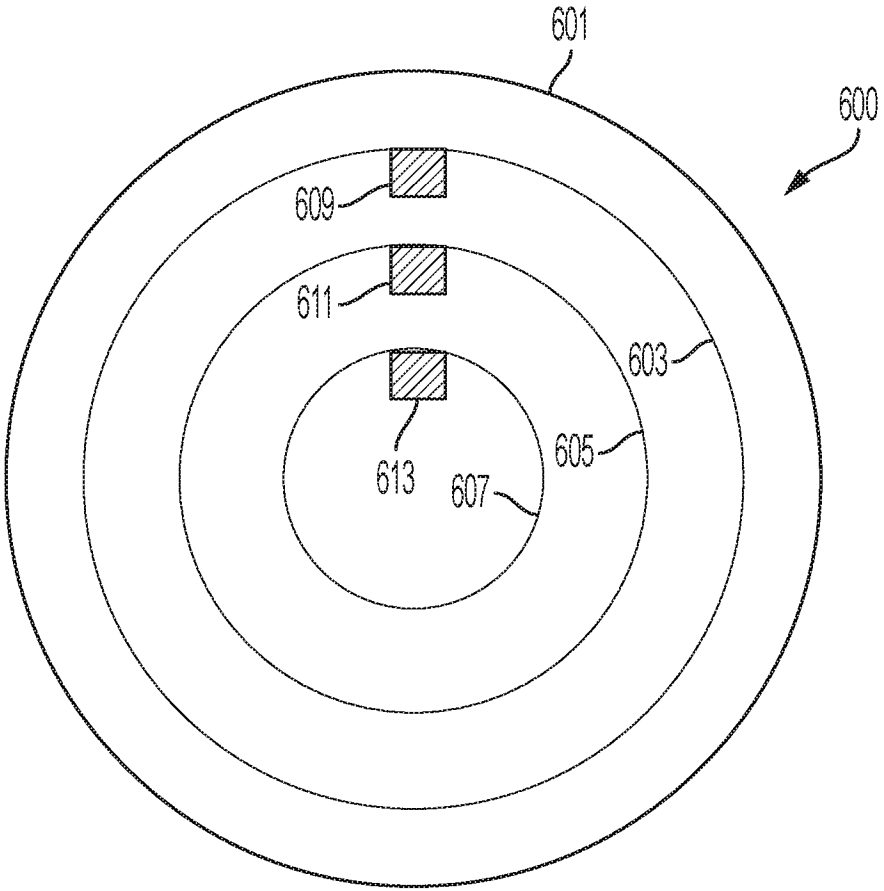
FIG. 6 is a block diagram of an example arrangement of sensors disposed at varying depths in a drill bit.

Referring to FIG. 6, an example cylindrical portion of an example drill bit 600 includes multiple sensors disposed at different distances from a surface of the drill bit body and configured to measure wear. Circle 601 indicates a dimension of an example drill bit 600 at full gauge. Circle 603 indicates a dimension of drill bit 600 that has been worn, through use, by 1.5 mm (0.06 inches) under full gauge. For example, following wear, drill bit 600 may have a circumference that is full gauge minus 1.5 mm (0.06 inches). When drill bit 600 worn to 1.5 mm (0.06 inches) under full gauge, sensor 605 is exposed to material in the wellbore, such as wellbore fluid or debris, which may cause sensor 609 to send data (or to cease sending data) to wireless data retrieval devices as they pass in proximity to drill bit 600.

Referring still to FIG. 6, circle 605 indicates a dimension of drill bit 600 that has been worn, through use, by 3 mm (0.12 inches) under full gauge. For example, following wear, drill bit 600 may have a circumference that is full gauge minus 3 mm (0.12 inches). When drill bit 300 worn to is 3 mm (0.12 inches) under full gauge, sensor 611 is exposed to material in the wellbore, such as wellbore fluid or debris, which may cause sensor 611 to send data (or to cease sending data) to wireless data retrieval devices as they pass in proximity to drill bit 600.

Referring still to FIG. 6, circle 607 indicates a dimension of drill bit 600 that has been worn, through use, by 4.5 mm (0.18 inches) under full gauge. For example, following wear, drill bit 600 may have a circumference that is full gauge minus 4.5 mm (0.18 inches). When drill bit 600 worn to is 4.5 mm (0.18 inches) under full gauge, sensor 613 is exposed to material in the wellbore, such as wellbore fluid or debris, which may cause sensor 613 to send data (or to cease sending data) to wireless data retrieval devices as they pass in proximity to drill bit 600.

Figure 7:
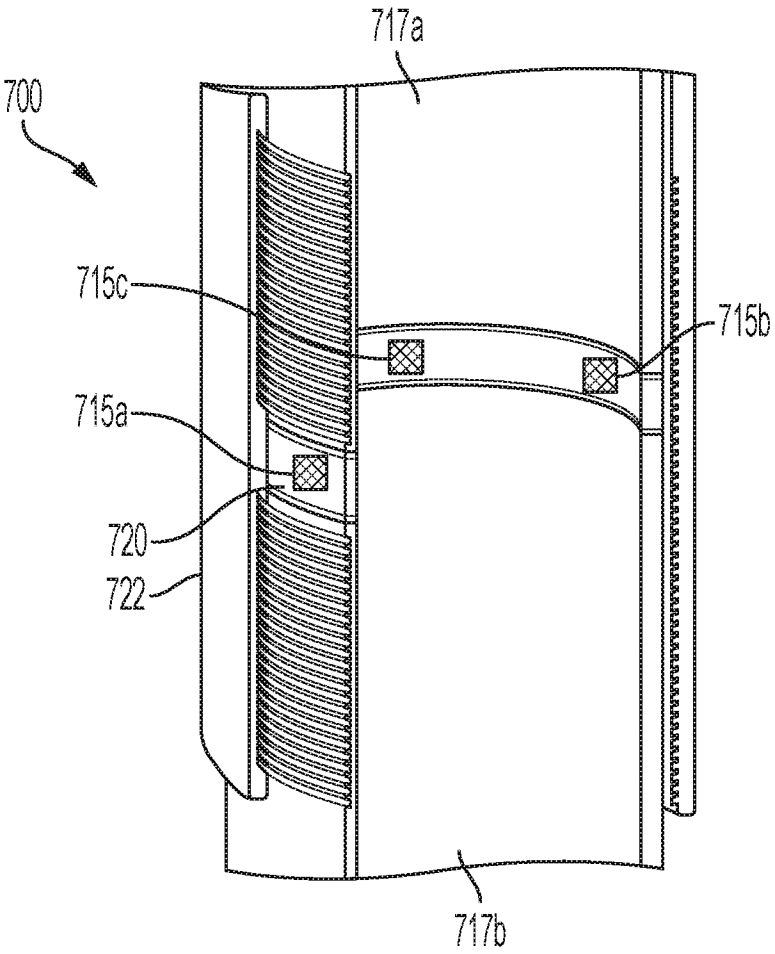
FIG. 7 is a view of an example torque ring with a plurality of torque-ring sensors disposed on or in the torque ring.

In some implementations, a wellbore drilling system is a CWD system that includes one or more torque rings configured to be disposed between adjacent casing pipes in a drill string. FIG. 7 shows a portion of an example drill string 700 of an example wellbore drilling system that includes torque ring 720. Torque rings are useful to, for example, improve centering and balance of the connection between casing pipes. For example, casing pipes joined using torque rings can be part of a drill string of a casing while drilling system. Moreover, torque rings can facilitate using higher torque during drilling or casing without damaging or degrading the connections between casing pipes. Example drill string 700 includes two casing pipes 717*a-b*. Casing pipes 717*a-b* are held together by collar 722 and spaced by torque ring 720. Torque ring 720 includes a hollow cylindrical body, for example made of solid metal. Wireless sensors 715*a-c* are disposed on or in torque ring 720. Wireless sensors 715*a-c* are disposed around the periphery of torque ring 720. In some implementations, a torque ring may be a multi-lobe torque (MLT) ring.

In some implementations, data is received from one or more wireless torque-ring sensors, one or more wireless drill bit sensors, or both one or more wireless torque-ring sensors and one or more wireless drill bit sensors by a data retrieval device. The data retrieval device is waterproof such that it does not degrade from exposure to the drilling fluid used in the drill string. The data retrieval device may be a wireless data retrieval device, such as an RFID-enabled, WLAN-enabled, or Bluetooth-enabled device. An RFID-enabled device may use a near-field communication (NFC) protocol to receive data from an RFID-enabled sensor. An RFID-enabled device may be configured to work with an active or passive RFID-enabled sensor or both active and passive RFID-enabled sensors. A wireless data retrieval device may include a memory for storing data received from one or more torque-ring sensors, one or more drill bit sensors, or both one or more torque-ring sensors and one or more drill bit sensors before transferring the data. In some implementations, a data retrieval device is an RFID chip, such as an encapsulated RFID chip.

Data received by a data retrieval device from multiple torque-ring sensors may be averaged to produce an average downhole condition. The average downhole condition may be over a single torque ring if the torque-ring sensors are disposed on or in a single torque ring. The average downhole condition may be averaged over a portion of the drill string if the torque-ring sensors are disposed on or in torque rings corresponding to a particular region of the drill string, for example in a 100 m (0.06 mi), 200 m (0.13 mi), 500 m (0.31 mi), or 1 km (0.62 mi) region of the drill string. The average downhole condition may be averaged over all of the torque-ring sensors in each torque ring in the drill string. Data may be averaged in the device after being received, for example using an active or passive circuit, or may be averaged by a computing system after being transferred.

Data received by a data retrieval device from multiple drill bit sensors may be averaged to produce an average downhole condition or an average drill bit condition. By averaging over multiple drill bit sensors spatially arranged around a drill bit body, for example in or on different portions of a drill bit body, a more accurate representation of the drill bit condition can be determined. Data received from one or more torque-ring sensors and from one or more drill bit sensors by a data retrieval device may be averaged to determine an average downhole condition.

Although the example drill bits, torque rings, and wellbore drilling systems have been described previously in the context of an oil or gas well, the example drill bits, torque rings, and wellbore drilling systems may be used with any appropriate type of well, including, but not limited to, water wells.

All or part of the systems and processes described in this specification and their various modifications may be controlled at least in part by a control system, such as an uphole computing system. The control system may be comprised of one or more computing systems using one or more computer programs. Examples of computing systems include, either alone or in combination, one or more desktop computers, laptop computers, servers, server farms, and mobile computing devices such as smartphones, features phones, and tablet computers.

The computer programs may be tangibly embodied in one or more information carriers, such as in one or more non-transitory machine-readable storage media. A computer program can be written in any form of programming language, including compiled or interpreted languages, and it can be deployed as a stand-alone program or as a module, part, subroutine, or unit suitable for use in a computing environment. A computer program can be deployed to be executed on one computer system or on multiple computer systems at one site or distributed across multiple sites and interconnected by a network.

Actions associated with implementing the processes may be performed by one or more programmable processors executing one or more computer programs. All or part of the tool, such as the controller contained in the tool, may be implemented using special purpose logic circuitry, for example, a field programmable gate array (FPGA) or an ASIC application-specific integrated circuit (ASIC), or both.

Processors suitable for use as the controller and to execute computer programs include, for example, both general and special purpose microprocessors, and include any one or more processors of any kind of digital computer. Generally, a processor will receive instructions and data from a read-only storage area or a random-access storage area, or both. Components of a computing system include one or more processors for executing instructions and one or more storage area devices for storing instructions and data. Generally, a computer and a controller will also include one or more machine-readable storage media, or will be operatively coupled to receive data from, or transfer data to, or both, one or more machine-readable storage media.

Non-transitory machine-readable storage media include mass storage devices for storing data, for example, magnetic, magneto-optical disks, or optical disks. Non-transitory machine-readable storage media suitable for embodying computer program instructions and data include all forms of non-volatile storage area. Non-transitory machine-readable storage media include, for example, semiconductor storage area devices, for example, erasable programmable read-only memory (EPROM), electrically erasable programmable read-only memory (EEPROM), and flash storage area devices. Non-transitory machine-readable storage media include, for example, magnetic disks such as internal hard disks or removable disks, magneto-optical disks, and CD (compact disc) ROM (read only memory) and DVD (digital versatile disk) ROM.

A computing device may include a hard drive for storing data and computer programs, one or more processing devices (for example, a microprocessor), and memory (for example, RAM) for executing computer programs.

Elements of different implementations described may be combined to form other implementations not specifically set forth previously. Elements may be left out of the tools and processes described without adversely affecting their operation or operation of the overall system in general. Furthermore, various separate elements may be combined into one or more individual elements to perform the functions described in this specification.

Throughout the description, where apparatus are described as having, including, or comprising specific components, or where processes and methods are described as having, including, or comprising specific operations, it is contemplated that, additionally, there are apparatus that consist essentially of, or consist of, the recited components, and that there are processes and methods that consist essentially of, or consist of, the recited processing operations.

It should be understood that the order of operations or order for performing certain action is immaterial so long as the process or method remains configured. Moreover, two or more operations or actions may be conducted simultaneously.

In this specification, unless otherwise clear from context or otherwise explicitly stated, (i) the term "a" may be understood to mean "at least one"; (ii) the term "or" may be understood to mean one or the other or both; (iii) the terms "comprising" and "including" may be understood to encompass itemized components or operations whether presented by themselves or together with one or more additional components or operations; and (iv) where ranges are provided, endpoints are included. Any numerals used in this application with or without about/approximately are meant to cover any normal fluctuations appreciated by one of ordinary skill in the relevant art. Where imperial units are given they are approximated values of the corresponding metric units.

Other implementations not specifically described in this specification are also within the scope of the following claims.

What is claimed is:

1. A method for monitoring drilling in a wellbore, the method comprising:

releasing a wireless data retrieval device within a drill string disposed in the wellbore;

forcing fluid downhole through the drill string such that the wireless data retrieval device travels in the fluid through each of a plurality of torque rings each disposed between ends of two casing pipes in the drill string and then a fluid outlet in a drill bit connected to the drill string;

receiving data in the wireless data retrieval device from one or more wireless sensors disposed on or in each of the plurality of torque rings;

transferring the data from the wireless data retrieval device after the wireless data retrieval device travels in the fluid through the fluid outlet; and determining an average downhole condition averaged over a portion of the drill string based, at least in part, on the data received from the one or more wireless sensors disposed on or in each of the plurality of torque rings.

2. The method of claim 1, where the wireless sensor is an RFID-enabled sensor.

3. The method of claim 1, comprising retrieving the wireless data retrieval device from the fluid when the fluid exits the wellbore.

4. The method of claim 3, where the data is transferred after the wireless data retrieval device has been retrieved.

5. The method of claim 1, where transferring the data from the wireless data retrieval device occurs as the fluid exits the wellbore.

6. The method of claim 1, where the data is transferred from the wireless data retrieval device to a non-transitory machine-readable storage medium using an RFID reader.

7. The method of claim 1, where the data is transferred using a near-field communication protocol.

8. The method of claim 1, comprising:

releasing wireless data retrieval devices into the drill string;

forcing fluid downhole through the drill string such that each of the plurality of wireless data retrieval devices travel in the fluid through a fluid outlet in the drill bit;

receiving respective data in each of the wireless data retrieval devices from one or more wireless sensors disposed on or in a body of the drill bit and/or one or more wireless sensors disposed on or in one or more of the one or more torque rings; and transferring the respective data from the plurality of wireless data retrieval devices.

9. The method of claim 8, comprising retrieving the plurality of wireless data retrieval devices from the fluid when the fluid exits the wellbore, where transferring the data from the plurality of wireless data retrieval devices occurs after all of the plurality of wireless data retrieval devices have been retrieved.

10. The method of claim 1, where the data correspond to at least one of temperature, pressure, acceleration, torque, or rotational velocity.

11. The method of claim 8, comprising receiving wear data in at least one of the wireless data retrieval devices from the one or more wireless sensors disposed on or in the body of the drill bit and determining bit wear based, at least in part, on the wear data.

12. The method of claim 8, comprising receiving stick-slip data in at least one of the wireless data retrieval devices from the one or more wireless sensors disposed on or in the body of the drill bit and determining whether stick-slip is occurring based, at least in part, on the stick-slip data.

13. The method of claim 8, comprising receiving drag data in at least one of the wireless data retrieval devices from the one or more wireless sensors disposed on or in the body of the drill bit and determining drill string drag based, at least in part, on the drag data.

14. The method of claim 8, comprising receiving weight-on-bit data in at least one of the wireless data retrieval devices from the one or more wireless sensors disposed on or in the body of the drill bit and determining weight-on-bit based, at least in part, on the weight-on-bit data.

15. The method of claim 8, comprising receiving vibration data in at least one of the wireless data retrieval devices from the one or more wireless sensors disposed on or in the body of the drill bit and determining drill string vibration based, at least in part, on the vibration data.

16. The method of claim 8, comprising receiving bit balling data in at least one of the wireless data retrieval devices from the one or more wireless sensors disposed on or in the body of the drill bit and determining a state of bit balling based, at least in part, on the bit balling data.

17. The method of claim 8, comprising receiving data in at least one of the wireless data retrieval devices from a plurality of wireless sensors disposed on or in the body of the drill bit.

18. The method of claim 17, comprising determining an average downhole condition, an average drill bit condition, or both an average downhole condition and an average drill bit condition, based, at least in part, on the data received from each of the plurality of wireless sensors disposed on or in the body of the drill bit.

19. The method of claim 1, comprising determining an average downhole condition based, at least in part, on data received from at least one of the one or more wireless sensors disposed in or on at least one of the one or more torque rings and a wireless sensor disposed on or in a body of the drill bit.

* * * * *